US006543155B2

(12) United States Patent
Horigane

(10) Patent No.: US 6,543,155 B2
(45) Date of Patent: Apr. 8, 2003

(54) FREEZE-DRIED PRODUCT AND PROCESS AND APPARATUS FOR PRODUCING IT

(75) Inventor: Akira Horigane, Tsukuba (JP)

(73) Assignee: National Agricultural Research Organization, Tsukuba (JP)

( * ) Notice: Subject to any disclaimer, the term of this patent is extended or adjusted under 35 U.S.C. 154(b) by 0 days.

(21) Appl. No.: 10/252,072

(22) Filed: Sep. 20, 2002

(65) Prior Publication Data

US 2003/0014879 A1 Jan. 23, 2003

Related U.S. Application Data

(63) Continuation-in-part of application No. 09/981,378, filed on Oct. 17, 2001.

(30) Foreign Application Priority Data

Mar. 1, 2001 (JP) ..... 2001-057345
Feb. 27, 2002 (JP) ..... 2002-050602

(51) Int. Cl.[7] ..... F26B 5/06

(52) U.S. Cl. ..... 34/296; 34/289; 34/321; 34/406; 34/92; 426/385

(58) Field of Search ..... 34/284, 289, 295, 34/296, 312, 315, 318, 320, 321, 402, 403, 406, 58, 92; 426/384, 385, 465, 443

(56) References Cited

U.S. PATENT DOCUMENTS

| | | | | | |
|---|---|---|---|---|---|
| 2,215,265 | A | | 9/1940 | Flosdorf | 34/80 |
| 2,388,917 | A | | 11/1945 | Hormel | 34/295 |
| 4,275,511 | A | * | 6/1981 | Parkinson et al. | 34/92 |
| 4,455,135 | A | * | 6/1984 | Bitterly | 432/1 |
| 4,590,684 | A | * | 5/1986 | Arsem | 34/284 |
| 5,309,649 | A | | 5/1994 | Bergmann et al. | 34/284 |
| 5,433,020 | A | * | 7/1995 | Leech, Jr. | 34/403 |
| 5,438,838 | A | * | 8/1995 | Sitte et al. | 62/55.5 |
| 5,787,716 | A | * | 8/1998 | Allen, Jr. | 62/63 |
| 5,822,882 | A | * | 10/1998 | Anger | 34/408 |
| 6,058,625 | A | * | 5/2000 | Kieselback et al. | 34/408 |
| 6,098,410 | A | * | 8/2000 | Horigane | 62/62 |
| 6,163,979 | A | | 12/2000 | Oetjen et al. | 34/286 |

FOREIGN PATENT DOCUMENTS

| | | |
|---|---|---|
| DE | 1 102 654 | 3/1961 |
| DE | 296 21 917 U1 | 4/1997 |
| EP | 0 917 825 A2 | 5/1999 |
| FR | 1 378 749 | 11/1964 |
| JP | 3005657 | 11/1997 |
| WO | WO96/31748 | 10/1996 |

* cited by examiner

*Primary Examiner*—Ira S. Lazarus
*Assistant Examiner*—Kathryn S. O'Malley
(74) *Attorney, Agent, or Firm*—Flynn, Thiel, Boutell & Tanis, P.C.

(57) ABSTRACT

Freeze-dried products of high quality produced from materials to be freeze-dried in a freeze-drying apparatus comprising a sealed vessel enclosing a processing chamber provided therein with a rotary cage receiving a gas-permeable container containing frozen pieces of the said material, prepared by freezing the said material with a refrigerant, and a heating device for heating the frozen material by radiant heat rays, wherein the freeze-dried product is produced by a process which can attain, even when dry ice is used as the refrigerant, efficient sublimating removal of large amount of carbon dioxide gas evolved from dry ice and of moisture included in the material, while preventing adhesion of the frozen pieces of the said material to each other and while permitting reduction of the sublimation duration, wherein the frozen material retained in the gas-permeable container placed in the rotary cage is heated uniformly by the heating device under vacuum condition while it is being maintained under rotational movement to thereby facilitate the volatilized removal of the refrigerant and of the frozen moisture from the frozen material.

15 Claims, 3 Drawing Sheets

FREEZE-DRIED PRODUCT AND PROCESS AND APPARATUS FOR PRODUCING IT

This is a continuation-in-part of Ser. No. 09/981,378 filed Oct. 17, 2001.

FIELD OF THE INVENTION

The present invention relates to a freeze-dried product produced from a frozen material to be freeze-dried, obtained by mixing the material with a refrigerant, such as dry ice, by removing the refrigerant and frozen moisture (ice) included in the material from the frozen material under sublimation, and to a process and an apparatus for the production thereof.

BACKGROUND OF THE INVENTION

Methods have heretofore been proposed for producing freeze-dried products which are obtained from materials to be freeze-dried by freezing with dry ice and then removing dry ice and contained ice from the frozen materials. For example, a process has been proposed in Japanese Patent No. 3005657 C, which comprises mixing the material to be freeze-dried, such as a raw biotic material, drug, food or industrial raw material, with dry ice under compression to form a frozen mass, crushing the frozen mass into disintegrated frozen fragments and drying the frozen fragments under vacuum condition.

By processing the material to be freeze-dried by mixing it with dry ice so as to attain substantially instantaneous freezing of the material while replacing ambient atmosphere by carbon dioxide gas evolved from dry ice under sublimation and while drying the resulting frozen material under vacuum condition, the freeze-dried product of the material, which retains the original quality and properties of the material as such, can be obtained using a simple apparatus with easy operation without suffering from denaturation of the material due to the influences of oxygen, enzymes and heat. The resulting freeze-dried product, which is an inactive matter retaining the quality and properties of the original material, is permissible of being stored, transported and utilized without suffering from denaturation by the action of oxygen, heat etc.

Conventionally employed freeze-drying apparatuses have a construction in which a plurality of heating shelves in a form of a multistage unit are installed in a tightly sealed vessel provided with an exhaustion manifold and a flap closure lid for opening and closing the open end of the vessel. The frozen material to be freeze-dried is placed on each shelf and the shelves holding the frozen material are brought in the internal chamber of the sealed vessel via the open end. The vessel is closed and the tightly sealed chamber retaining the shelves is evacuated to vacuum, whereupon the shelves are heated to effect vacuum drying of the frozen material on the shelves, while the gases and moisture given off under sublimation from the frozen material are sucked out into a cold trap via the exhaustion manifold to condense the condensible ingredients, such as moisture etc., to remove them.

By such a conventional freeze-drying apparatus, a large scale processing of materials is difficult due to restrictions in the amount and the size of the material to be freeze-dried and due to the restricted volume of the interstitial space between the shelves, since many heating shelves are installed with inevitable reduction of total internal free spaces of the chamber. A further problem adds thereto that an irregular heat transfer on heating the material to be freeze-dried may occur due to confinement of the material within a narrow interstitial spaces between the shelves, resulting in occasional denaturation of the material caused by a possible local heat accumulation in the material at the portion near the heating surface, whereby a non-uniform product quality may occur. For example, a freeze-dried product of slices of strawberry or the like may suffer from a problematic phenomenon of adhesion of slices to each other at the mutual contact faces when the slices are held put together one over another, whereby the performance of freeze-drying may considerably be reduced due to reduction of free surfaces of the material. While a rotary pump has heretofore been used for the vacuum pump connected to the exhaust manifold, a higher vacuum in the tightly sealed vessel may difficultly be attained in case the material to be freeze-dried is present as a mixture with dry ice, since a considerable amount of carbon dioxide gas is evolved by sublimation of dry ice, so that efficient freeze-drying will not be realized due to the reduction in the vacuum-drying efficiency.

SUMMARY OF THE INVENTION

An object of the present invention is to provide a process for producing a high quality freeze-dried product of a material to be freeze-dried, in which the material frozen with a refrigerant is deprived of the refrigerant and moisture efficiently while excluding any adhesion of individual pieces of the frozen material to each other by maintaining the frozen material under rotation, whereby the time required for freeze-drying the material can be reduced and a uniform heating of the material can be realized, even when dry ice is used as the refrigerant, by enabling an efficient removal of carbon dioxide gas evolved from dry ice by sublimation in a considerable amount.

Another object of the present invention is to provide an apparatus for producing a high quality freeze-dried product of various materials, in which the material frozen with a refrigerant is deprived of the refrigerant and moisture efficiently while excluding any adhesion of individual pieces of the frozen material to each other by maintaining the frozen material under rotation, whereby the time required for freeze-drying the material can be reduced and a uniform heating of the material can be realized, even when dry ice is used as the refrigerant, by enabling an efficient removal of carbon dioxide gas evolved from dry ice by sublimation in a considerable amount.

A further object of the present invention is to provide high quality freeze-dried products using the process and apparatus as given above.

The present invention consists in the following process and apparatus for producing a high quality freeze-dried product as well as the freeze-dried product obtained thereby:

(1) A process for producing a freeze-dried product of a material to be freeze-dried, comprising the steps of
   - placing in a rotary cage installed in a sealed vessel of a freeze-drying apparatus a gas-permeable container containing one or more frozen pieces of the material to be freeze-dried, obtained by freezing the material with a refrigerant,
   - heating the frozen material by a heating device in the freeze-drying apparatus under vacuum condition and
   - evacuating the sealed vessel to vacuum so as to cause sublimation of frozen moisture included in the material under heating to produce the freeze-dried product.

(2) The process as defined in the above (1), wherein the frozen pieces of the material are held contained in the container in a condition not adhering to each other.

(3) The process as defined in the above (1), wherein the heating device consists of a heating lamp.

(4) The process as defined in the above (1), wherein the refrigerant consists of dry ice.

(5) The process as defined in the above (4), wherein the material to be freeze-dried is contained in the container in a state mixed with dry ice.

(6) The process as defined in the above (4), wherein the freeze-drying is performed under variation of the heating condition in accordance with the state of sublimation of dry ice.

(7) The process as defined in the above (4), wherein the freeze-drying is performed under variation of the evacuation condition in accordance with the state of sublimation of dry ice.

(8) The process as defined in the above (1), wherein the refrigerant consists of liquid nitrogen.

(9) An apparatus for freeze-drying a material to be freeze-dried, comprising a sealed vessel enclosing a processing chamber, a rotary cage installed in the processing chamber rotatably and served for receiving a gas-permeable container for containing one or more frozen pieces of the material to be freeze-dried, obtained by freezing the material with a refrigerant, a heating device arranged so as to permit to heat the frozen material to be freeze-dried, a cold trap with cooling element, connected to the processing chamber and an evacuating unit for evacuating the processing chamber via the cold trap to a reduced pressure.

(10) The apparatus as defined in the above (9), wherein the power transmission for rotating the rotary cage is effected by a magnet coupling.

(11) The apparatus as defined in the above (9), wherein the heating device consists of a heating lamp.

(12) The apparatus as defined in the above (9), wherein the heating device is constructed, in case the refrigerant comprises dry ice, so as to permit variation of the heating condition in accordance with the state of sublimation of dry ice.

(13) The apparatus as defined in the above (9), wherein the evacuating unit is constructed, in case the refrigerant comprises dry ice, so as to permit variation of the evacuation condition in accordance with the state of sublimation of dry ice.

(14) A freeze-dried product produced by the process as defined in the above (1).

(15) A food or a medicament comprising the freeze-dried product as defined in the above (14).

DETAILED DESCRIPTION OF THE INVENTION

Figure 1:
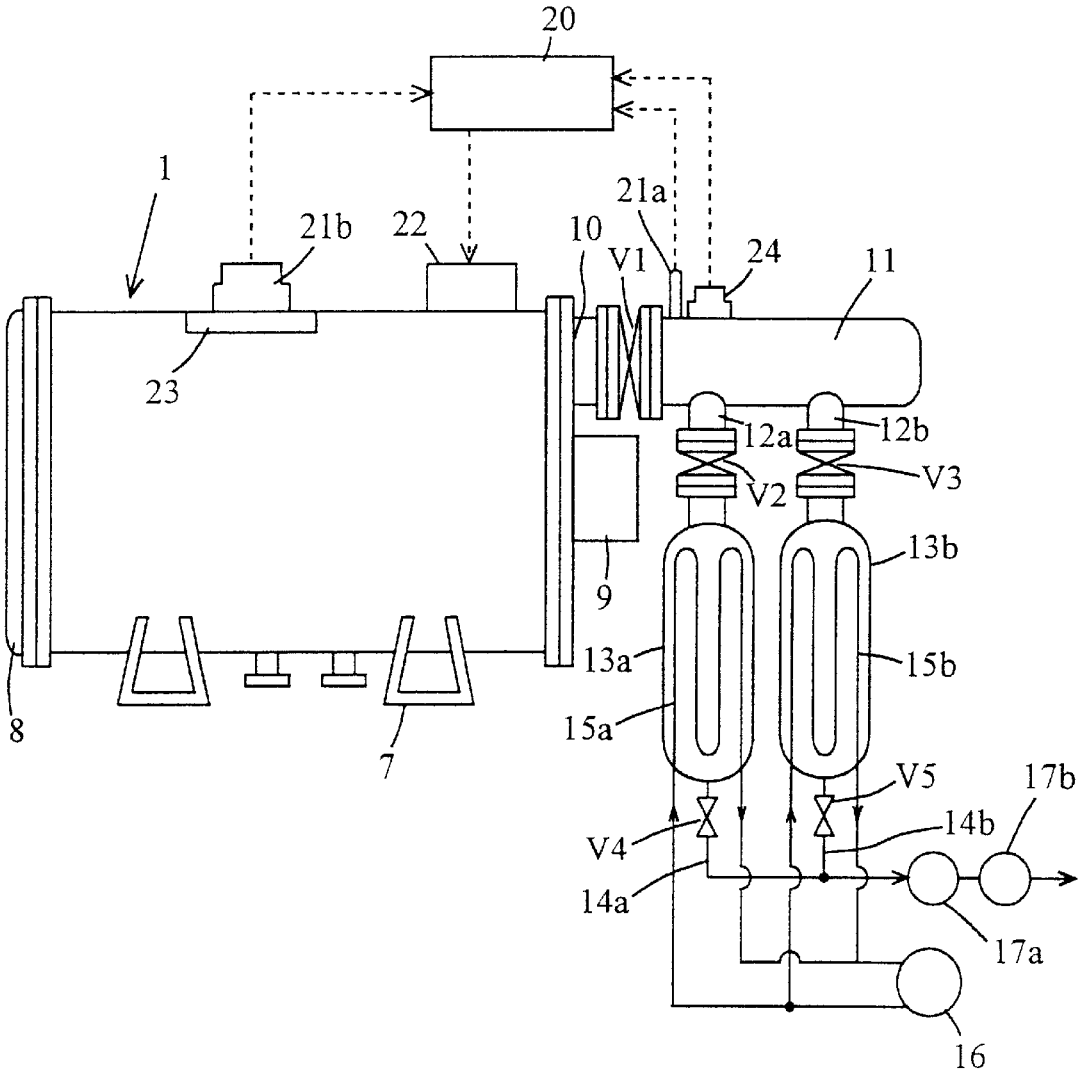
FIG. 1 shows an embodiment of the freeze-drying apparatus according to the present invention in a front view.

According to the present invention, every material which has conventionally been used as the object to be subjected to freeze-drying, including organic and inorganic matters and mixtures of them, may be dealt with. Above all, the invention favorably deals with materials subject to denaturation, such as biotic materials, organic substances, foods, drugs, test specimens of living organisms, fodder, industrial raw materials and so on, including materials which comprise, in particular, organic matters with molecules having functional groups and/or moieties subject to chemical degeneration by the action of oxygen, heat or enzymes. Such materials may be present in every arbitrary form, for example, lumps, liquid, jelly and slurry, including crushed or ground mass, powder and the like. While such material may typically be in a moistened form, dry materials may also be freeze-dried after they have been homogenized with addition of water or water-containing ingredient.

For the refrigerant to be used according to the present invention, any one which can freeze the material to be freeze-dried can be employed without any restriction. Concrete ones include dry ice, liquid nitrogen and mixtures of dry ice with aceton or with ethyl alcohol or the like. Among them, dry ice and liquid nitrogen are preferred with special preference to dry ice.

While the description given below is directed to the case of using dry ice which is favorable as the refrigerant, there is no limitation for the refrigerant and other refrigerants than dry ice may also be used in a similar way.

Dry ice is a compacted product of solidified carbon dioxide and sublimates under atmospheric pressure at a temperature of minus 78.5° C. into gaseous carbon dioxide. For dry ice, commercial products usually sold as coolant or the like may be used. Since dry ice can be crushed easily by a slight pressure impressed thereon in a mixer crusher, commercial products of voluntary forms and sizes can be employed, though granular products having grain sizes in the range from 1 to 5 cm are preferred. While the amount of dry ice to be used for freeze-drying may vary in accordance with each specific material to be freeze-dried, moisture content thereof, properties thereof and so on, an amount of 0.01–100 parts by weight, preferably 0.1 to 10 parts by weight, per one part by weight of the material to be freeze-dried, may be assumed.

According to the present invention, a frozen material to be freeze-dried, prepared by cooling the material with a refrigerant, such as dry ice, to freeze it, is subjected to freeze-drying in a freeze-drying apparatus. On preparing the frozen material, for example, the material is mixed with granular dry ice to thereby replace the ambient atmosphere by the carbon dioxide gas evolved from dry ice, while attaining substantially instantaneous freezing of the material. In one favorable embodiment of the present invention, the material and dry ice are crushed favorably in a mixer crusher, while replacing the ambient atmosphere by carbon dioxide gas evolved from dry ice under sublimation to thereby drive off atmospheric oxygen and attaining simultaneously an instantaneous freezing of the material to form the frozen material. Here, lumps of dry ice and the material are subjected to crushing in the mixer crusher, whereby dry ice lumps are disintegrated into fine grains closely intermingled with the crushed fragments of the material and the evolved carbon dioxide gas sublimated from dry ice by heat absorption expels the ambient atmosphere to establish an insulating atmosphere, while the crushed material is frozen substantially instantaneously. The resulting frozen material is present as a mass of mixture of the crushed material and dry ice grains. According to the present invention, it is preferable to perform freeze-drying of the material by placing the above-mentioned mixture of the material to be freeze-dried and granular dry ice in a gas-permeable container. When such a mixture of the material to be freeze-dried and granular dry ice is heated by a heating device, individual pieces of the material to be freeze-dried will become separated with each other on the progress of sublimation of dry ice and are rolled over and tumbled within the container upon rotation of the rotary cage while being subjected to freeze-drying, whereby the efficiency of the freeze- drying is increased.

In the present invention, the material cooled and frozen by a refrigerant, such as dry ice, in discrete pieces obtained, for example, in the manner as above, is subjected to freeze-drying in a freeze-drying apparatus in a state contained in a flexible container made of a gas-permeable material, such as cloth, non-woven fabric or paper, which permits free permeation of gases of sublimated refrigerant, gaseous moisture and so on.

The freeze-drying apparatus comprises a sealed vessel enclosing a processing chamber; a rotary cage installed in the processing chamber so as to permit rotating and reversing movements thereof for causing turbulent motion of the frozen material held therein; a heating device arranged so as to permit to heat the frozen material to promote sublimation of the refrigerant and the frozen moisture from the frozen material; and an evacuating unit connected to the processing chamber via a cold trap having cooling element to evacuate the processing chamber.

It is enough that the sealed vessel of the freeze-drying apparatus according to the present invention is constructed only so as to permit heating of the frozen material to be freeze-dried and evacuation of the processing chamber accommodating the rotary cage held rotatably therein and no limitation is placed on the configuration thereof.

The rotary cage is constructed so as to be installed rotatably in the processing chamber and to receive the container for containing the frozen pieces of the material to be freeze-dried and is made preferably in a form allowing easy transmission of radiant heat emitted from the heating device, for example, a mesh casing or cage made of wire or filament or a perforated carton formed from punched sheet or plate, made of stainless steel or other metal or of a plastic resin. The rotary cage may favorably be rotatable and/or reversible at a lower revolution rate in the range from 1 to 10 r.p.m. using an electric motor, in order to attain uniform irradiation of radiant heat emitted from the heating device over the material to be freeze-dried retained in the container. The rotary cage may be constructed in a magnet-driven form to effect rotation of the cage by transmitting the driving motion of the motor via a magnetic coupling or in a mechanical transmission form to effect rotation of the cage by transmitting the driving motion of the motor to a transmission roller arranged between the sealed vessel and the rotary cage.

The heating device may be disposed internally and/or externally of the processing chamber so as to attain heating of the frozen material retained in the rotary cage from outside. The heating device may preferably be so constructed that the condition of heating can be varied in accordance with the state of sublimation of dry ice, since heating of the material to be freeze-dried will cause also sublimation of dry ice intermingled therewith. Here, the heating condition may be controlled in such a manner that the temperature of the heating device is adjusted, before termination of sublimation of dry ice, at 30–100° C., preferably at 60–80° C., and is adjusted, after the termination of sublimation of dry ice and, thus, after commencement of sublimation of frozen moisture (ice), at 20–80° C., preferably at 20–40° C., in order to cope with the variation of course intervals prevailing for the sublimation of dry ice and of the frozen moisture to perform sublimating removal of dry ice and moisture in an efficient manner. Whether or not the sublimation of dry ice has been terminated can be judged by, for example, observing temperature change of the frozen material container, change of degree of vacuum in the processing chamber or change of carbon dioxide concentration in the evacuated gas.

The heating device is preferably composed of a heating lamp or a far infrared ceramic heater having a high spectral radiation peak near the absorption band of carbon dioxide, in order to attain efficient heat absorption by the dry ice intermingled with the material to be freeze-dried in the container to facilitate the sublimation of dry ice. The heating device may preferably be controlled by a control unit which detects, for example, decrease in the carbon dioxide concentration in the sucked out gas or increase of the surface temperature of the material to be freeze-dried due to exhaustion of dry ice, by means of a $CO_2$ gas sensor, thermocouple, thermistor, thermography or so on and the detected change is used for controlling the heating condition of the heating device by decreasing the heating device output power so as to effect most efficient sublimation of dry ice and of frozen moisture contained in the material to be freeze-dried but not to cause any chemical or physical degeneration of the material. Use of a heating lamp may have an advantage of permitting a prompt heating by radiant rays and a whole surface heating by reflection. In using a heating lamp, the sealed vessel may preferably be made of a metal, such as stainless steel, so as to permit to constitute the inner face thereof by a mirror surface to cause the radiant rays to be reflected.

The evacuating unit may preferably be constructed so as to permit to change the evacuating condition before and after the termination of the dry ice sublimation. It is favorable to maintain the pressure in the processing chamber in the range from 0.1 to 1,000 Pa, preferably from 0.1 to 100 Pa, more preferably from 0.1 to 10 Pa, in order to implement freeze-drying of a material. Here, it is favorable to employ a vacuum pump having greater gas exhaustion capacity during the dry ice sublimation period and to use a high-vacuum pump capable of attaining a high degree of vacuum during the subsequent period, in order to suck out a large amount of carbon dioxide gas evolved from dry ice during the primary dry ice sublimation period and to effect in the subsequent period an efficient intrinsic freeze-drying of the material to be freeze-dried to obtain a high quality freeze-dried product. Thus, the evacuating unit may preferably comprise a large evacuation capacity pump, such as a mechanical booster pump, for exhausting out a large amount of carbon dioxide evolved under sublimation from dry ice by heating, and a vacuum pump for attaining a high degree of vacuum, such as a conventionally employed rotary vacuum pump, wherein these pumps are controlled for their operational condition by the control unit.

The freeze-drying of the objective material by the freeze-drying apparatus described above is carried out in such a manner that a gas-permeable container containing the frozen objective material which is obtained by freezing it with a refrigerant is placed in the rotary cage in the freeze-drying apparatus, whereupon the rotary cage is rotated with occasional inversion of rotation in order to subject the frozen material in the gas-permeable container to rolling motion and/or collision to bring about always refreshed surfaces of the frozen material, whereby an efficient sublimation of the included frozen moisture from the frozen material under facilitation by heating of the frozen material by the heating device, namely, the freeze-drying of the material, can be realized.

By the process as described above, a high throughput with efficient sublimating removal of dry ice and of the included moisture can be realized, due to the technical measure of installation of the rotary cage receiving therein gas-permeable container containing a lot of the frozen pieces of the objective material to be freeze-dried in the processing chamber. The freeze-drying can be performed thereby efficiently by the efficient sublimating removal of carbon dioxide evolved in large amount from dry ice as well as of the moisture included in the objective material. By the technical measure of performing the freeze-drying with rotational or swivelling motion of the frozen material, any possibility for the material contained in the gas-permeable container in plural numbers to build up a clogging block obstructing sublimation of dry ice and the moisture included in the material is excluded, whereby an efficient vacuum drying is assured while preventing quality degeneration due to irregular heating of the frozen pieces of the material to be freeze-dried.

Due to incorporation of different heating conditions by the heating unit before and after the termination of dry ice sublimation, the total sublimation efficiency is increased and the intrinsic freeze-drying of the objective material can be realized at a temperature at which any denaturation of the material is excluded. By varying the condition of evacuation by the evacuating unit in accordance with the state of sublimation of dry ice, the evacuation can be realized under a condition adapted to the exhaustion of sublimated carbon dioxide gas and gaseous moisture, whereby an efficient freeze-drying can be attained.

When a refrigerant other than dry ice, such as liquid nitrogen, is used, freezing of the material can be attained by, for example, immersing the material in the liquid nitrogen. The freeze-drying of the material to be freeze-dried may preferably be performed in a state in which the material frozen as above is placed in a gas-permerable container while excluding any adhesion of individual pieces of the frozen material to each other, in order to prevent decrease of over-all surface areas of the frozen material due to adhesion of individual pieces of the material to each other and in order to increase the efficiency of the freeze-drying. Here, it is meant by "excluding any adhesion of individual pieces of the frozen material to each other", that individual pieces of the frozen material are maintained in a state separated from each other or such separated state can be secured by rotation of the rotary cage.

When liquid nitrogen is used, generation of gas from the refrigerant may not occur or, if occurs, in only a restricted amount, as contrasted to the case of using dry ice as the refrigerant. Thus, the most part of the gas evolved during the freeze-drying under heating of the material is constituted of steam (water vapor) formed by sublimation of ice included inherently in the material or the ice adhered on the material, so that heating of the material can be realized at a temperature adapted to sublimation of ice, whereby the control of the heating condition before and after the termination of sublimation of dry ice as required on using dry ice as the refrigerant can be dispensed with. In addition, employment of a large evacuation capacity pump, such as a mechanical booster pump, for exhausting out a large amount of carbon dioxide evolved from dry ice, can be excluded and the freeze-drying process can be realized using only a conventional rotary type vacuum pump.

The freeze-dried product obtained as above can be used, stored and transported as such or in a form of mixture with one or more of other freeze-dried products in accordance with each specific material, for, such as for example, foods, medicaments, biological samples, fodders and industrial raw materials. The freeze-dried product obtained as above can be restored by addition of water into, for example, foods, medicaments, biological samples, fodders and industrial raw materials.

As described above, a high quality freeze-dried product of the objective material can be obtained by the freeze-drying apparatus according to the present invention, which comprises a sealed vessel enclosing a processing chamber accommodating a rotary cage receiving gas-permeable container containing one or more pieces of the frozen objective material obtained by cooling with a refrigerant. Even in the case of using dry ice as the refrigerant, it is possible, by performing the freeze-drying while imparting rotational or swivelling movements to the frozen material contained in the gas-permeable container, to effect sublimation of dry ice and of the moisture present in the frozen objective material efficiently while providing for always refreshed surfaces of the frozen material to be exposed and while excluding any adhesion of individual pieces of the frozen material to each other, whereby uniform exposure of surfaces of the frozen material to the heating is attained, resulting in a high quality freeze-dried product and a reduction of requisite time for freeze-drying.

THE BEST MODE FOR EMBODYING THE INVENTION

Below, the present invention is described in more detail by way of embodiments with reference to the drawings appended.

Figure 2:
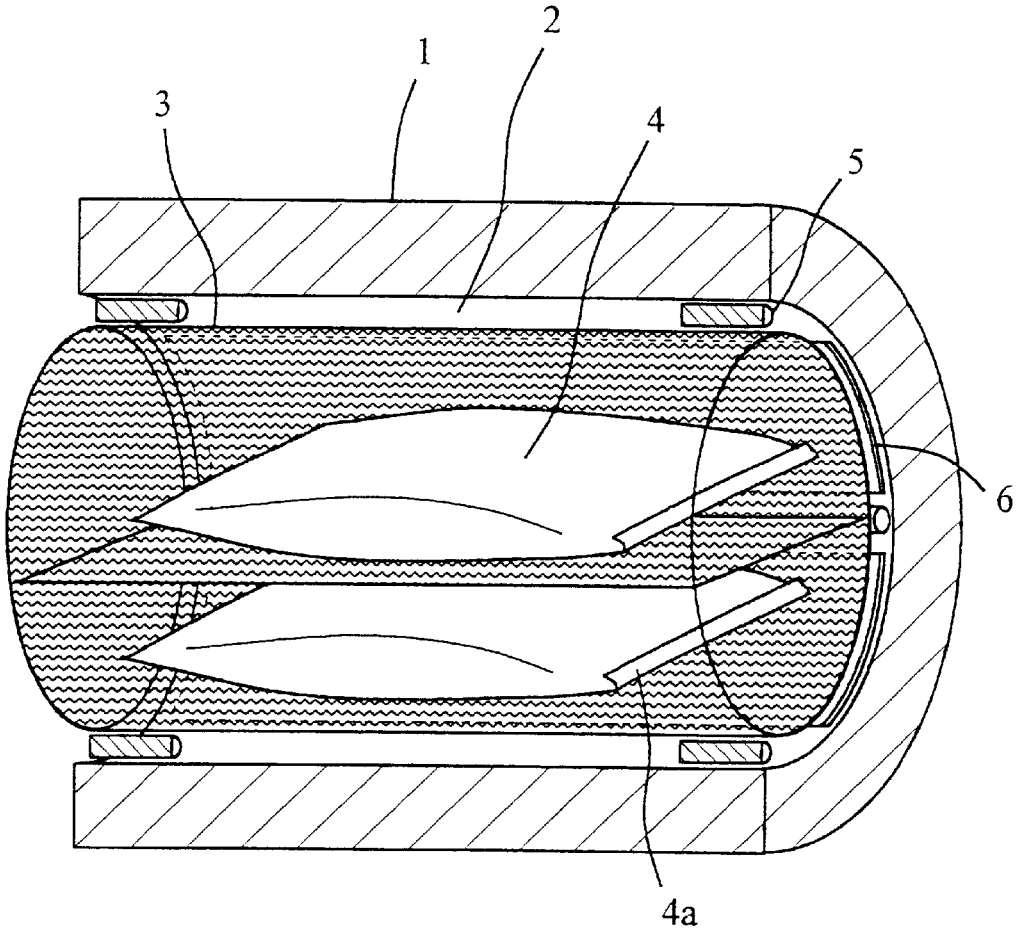
FIG. 2 is a partly cut off perspective view of the main part of the freeze-drying apparatus according to the present invention.

Referring to FIGS. 1 and 2 illustrating one embodiment of the apparatus for realizing freeze-drying according to the present invention, the apparatus comprises a cylindrical sealed vessel 1 enclosing a processing chamber 2 in which a rotary cage 3 for receiving a gas-permeable container 4 containing one or more pieces of the frozen material to be freeze-dried, prepared preliminarily by mixing the material with dry ice, is installed rotatably under support on roller bearings 5. A heating device 6 surrounding the rotary cage 3 is arranged in the processing chamber 2 to heat the frozen objective material contained in the gas-permeable containers 4. The sealed vessel 1 is supported on a support 7 and provided at its one end with a closure lid 8 and at its another end with an electric motor 9 to serve for rotation of the rotary cage 3. When the driving power of the electric motor 9 is transmitted to the rotary cage 3 via a magnet coupling, vacuum leakage can favorably be prevented. Here, the magnet coupling may be built up by arranging a driving magnet (not shown) outside the processing chamber 2 and a driven magnet (not shown) inside the processing chamber 2, respectively, wherein the driving magnet is caused to rotate by means of the driving power of the electric motor 9 so as to cause the driven magnet to follow the rotation of the driving magnet, whereby the rotary cage is rotated. It is also possible to rotate the rotary cage 3 by transmitting thereto the driving power of the electric motor 9 via a transmission roller 5 arranged between the processing chamber 2 and the rotary cage 3.

The sealed vessel 1 is equipped at the said another end thereof with an evacuation port 10 for evacuating the sublimated carbon dioxide gas and the moisture sublimated from the frozen objective material. The evacuation port 10 is connected via a conduit 11 provided with a valve V1 to a cold trap (13*a,* 13*b,* arranged here in two sets) via a connection line (12*a,* 12*b*) provided with a valve (V2, V3). The cold trap (13*a,* 13*b*) is constructed in such a manner that it is provided internally with a cooling element (15*a,* 15*b*) which is connected to a refrigerator 16 to pass the refrigerant cooled in the refrigerator 16 therethrough for trapping thereon the evacuated moisture from the processing chamber 2 under freezing. The cold trap (13*a,* 13*b*) is connected to a mechanical booster vacuum pump 17*a* via a connection line (14*a,* 14*b*) provided with a valve (V4, V5) and, then, to an oil rotary vacuum pump 17*b* in series, in order to maintain the finally adjusted degree of vacuum in the processing chamber 2 of, preferably, about 0.1 to 10 Pa.

For the heating device 6, ordinary type one may be employed, wherein preference is given to those based on heat ray radiation, though those based on heat conduction or convection may also be permissible. In the embodiment illustrated in FIG. 2, a plurality of ceramic heaters are used for the heating device 6 and are arranged over the inside face of the sealed vessel 1. Individual pieces of the frozen objective material to be freeze-dried retained in the gas-permeable container 4 are heated by exposing always refreshed surfaces thereof to the radiant heat rays of, such as far infrared, of the heating device 6 by holding them under rotational or swivelling movement in the container 4 by the rotation of the rotary cage 3 receiving the container 4. For the heating device 6, that of a form of flat board may also be employed instead of the far infrared radiant ray heater.

A control unit 20 serves for controlling the operation of the apparatus in such a way that the electric power of an electric power supply unit 22 of the heating device 6 is controlled by an electric signal delivered from a $CO_2$ gas sensor 24 located at a portion near the evacuation port 10 and/or by an electric signal delivered from a temperature detector 21*a* and/or by an electric signal delivered from a temperature detector 21*b,* such as a radiation thermometer, located on the sealed vessel 1 to detect the temperature through an inspection window 23.

Now, the description is directed to the practical manner for carrying out the freeze-drying by means of the freeze-drying apparatus described above.

First, the refrigerator 16 of the cold trap (13*a,* 13*b*) is actuated by switching it on. When the temperature of the cold trap (13*a,* 13*b*) reaches minus 40° C. or lower, the gas-permeable containers 4 containing several frozen pieces of the objective material with their mouths 4*a* being sealed are placed in the rotary cage 3. After closure of the lid 8, the vacuum pumps 17*a* and 17*b* are actuated. When the internal pressure of the processing chamber 2 has reached about 50 Pa, the rotary cage 3 is caused to rotate at a revolution rate of 1–10 r.p.m., while operating the heating device 6 so as to heat uniformly the frozen pieces by irradiating them by radiant heat rays. The objective material to be freeze-dried becomes loosened and mobile, as the sublimation of dry ice with heating progresses, and adhesion of individual pieces of the frozen material to each other is prevented by the rotation of the rotary cage. The sublimated large amount of carbon dioxide gas from dry ice during the dry ice sublimation period is exhausted out principally by the mechanical booster pump 17*a* in an efficient manner. Here, the condition of sublimation of dry ice is monitored by a temperature detector 21*a* disposed at a position near the evacuation port 10. When a steep temperature rise of about 20° C. is detected upon termination of the dry ice sublimation, an electric signal corresponding thereto is delivered from the control unit 20 to the electric power supply unit 22 to thereby adjust the electric power to the heating device 6 adaptively in accordance with the existing state of the sublimation of dry ice, in order to prevent occurrence of any deterioration of the quality of the freeze-dried product. After termination of the dry ice sublimation, the evacuation is effected mainly by the oil rotary vacuum pump 17*b* to cope with the change of sublimation state, whereby a highly efficient sublimation of frozen moisture is realized while maintaining a high degree of vacuum. The sublimated gaseous moisture from the frozen material is caught in the cold trap (13*a,* 13*b*), where it is collected thereon by being frozen into ice, whereby the freeze-drying proceeds efficiently and the resulting freeze-dried product is preserved in the gas-permeable container 4 as the final product of manufacture.

In the apparatus described above, the processing chamber 2 is provided, on the one hand, with the heating device 6 which compensate the latent heats of sublimation of dry ice and of the included moisture from the frozen material in the gas-permeable container 4 and, on the other hand, with a rotary cage 3 which receives the gas-permeable containers 4 containing the frozen material and serves for maintaining the frozen material under rotating or swivelling movement to thereby prevent occurrence of adhesion of individual pieces of the frozen material in the container to each other and to assure uniform irradiation of the frozen material by radiant heat rays, whereby the efficiency of freeze-drying can be increased and possible occurrence of deterioration of the quality of the freeze-dried product due to local heat accumulation can be prevented. By keeping the frozen material contained in the gas-permeable container 4 under a rotational movement by rotating the rotary cage 3 within the processing chamber 2, the efficiency of vacuum-drying can be increased and, at the same time, any deterioration of quality of the freeze-dried product can be prevented. The freeze-dried product can be taken out from the processing chamber 2 after it is freeze-dried and be stored in dry state.

Figure 3:
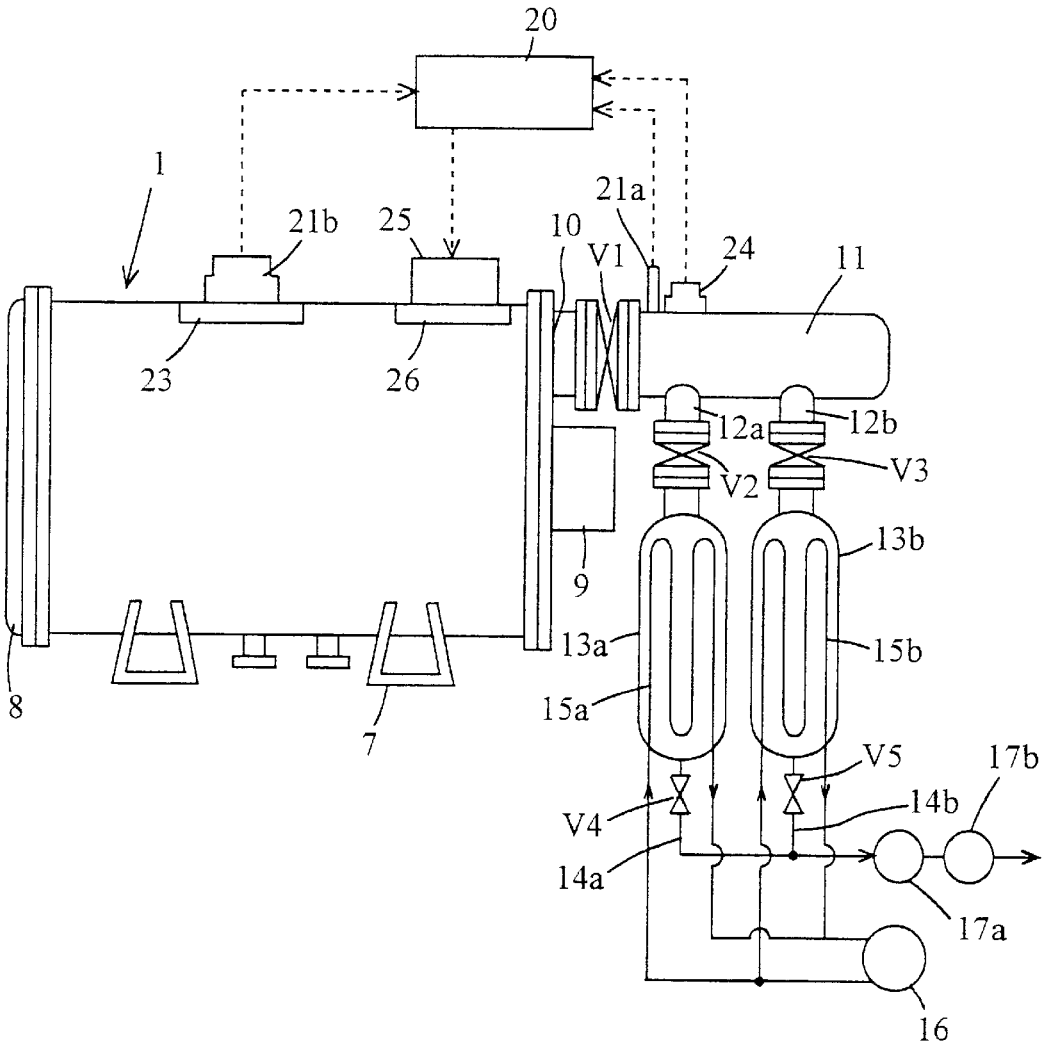
FIG. 3 shows another embodiment of the freeze-drying apparatus according to the present invention in a front view.

In FIG. 3, another embodiment of the freeze-drying apparatus according to the present invention is shown in front view, in which a heating lamp, such as a halogen lamp, is used as the heating device for heating the frozen material to be freeze-dried. In the apparatus shown in FIG. 3, a heating lamp 25 is arranged outside the sealed vessel 1 and serves for heating the frozen material to be freeze-dried by irradiating radiant ray onto the material present in the processing chamber 2 through one or more radiant ray permeable windows 26 made of a transparent heat resistant toughened glass disposed on the sealed vessel 1. The internal surface of the sealed vessel 1 made of a stainless steel is polished into a mirror to reflect the rays introduced into the processing chamber 2 through the windows from the heating lamp 25 to facilitate heating of the frozen material to be freeze-dried. The actuation of the heating lamp 25 is controlled by a control unit 20, in which the heating lamp 25 is tuned to a low level output by a control signal delivered from the control unit 20 upon arrival of the detected temperature at the turning point of termination of dry ice sublimation. It is possible to arrange one or more heating lamps 25. When heating lamp 25 is employed, the heating device 6 disposed within the processing chamber 2 as shown in FIG. 2 can be dispensed with.

When liquid nitrogen is used as the refrigerant instead of dry ice, installation of the mechanical booster vacuum pump 17*a* may be omitted, since in this case the amount of gases generated upon initiation of the freeze-drying is considerably small. The freeze-drying may preferably be performed in such a way that frozen pieces of the material to be freeze-dried are retained in the gas-permeable container 4 in a state in which they are held freely without being adhered to each other, namely, their rolling and tumbling movements can be guaranteed by the rotation of the rotary cage 3 receiving the container 4.

What is claimed is:

1. A process for producing a freeze-dried product of a material to be freeze-dried, comprising the steps of placing in a rotary cage installed in a sealed vessel of a freeze-drying apparatus a gas-permeable container containing one or more frozen pieces of the material to be freeze-dried, obtained by freezing the material with a refrigerant, heating the frozen material by a heating device in the freeze-drying apparatus under vacuum condition and evacuating the sealed vessel to vacuum so as to cause sublimation of frozen moisture included in the material under heating to produce the freeze-dried product.

2. The process as claimed in claim 1, wherein the frozen pieces of the material are held contained in the container in a condition not adhering to each other.

3. The process as claimed in claim 1, wherein the heating device consists of a heating lamp.

4. The process as claimed in claim 1, wherein the refrigerant consists of dry ice.

5. The process as claimed in claim 4, wherein the material to be freeze-dried is contained in the container in a state mixed with dry ice.

6. The process as claimed in claim 4, wherein the freeze-drying is performed under variation of the heating condition in accordance with the state of sublimation of dry ice.

7. The process as claimed in claim 4, wherein the freeze-drying is performed under variation of the evacuation condition in accordance with the state of sublimation of dry ice.

8. The process as claimed in claim 1, wherein the refrigerant consists of liquid nitrogen.

9. An apparatus for freeze-drying a material to be freeze-dried, comprising a sealed vessel enclosing a processing chamber, a rotary cage installed in the processing chamber rotatably and served for receiving a gas-permeable container for containing one or more frozen pieces of the material to be freeze-dried, obtained by freezing the material with a refrigerant, a heating device arranged so as to permit to heat the frozen material to be freeze-dried, a cold trap with cooling element, connected to the processing chamber and an evacuating unit for evacuating the processing chamber via the cold trap to a reduced pressure.

10. The apparatus as claimed in claim 9, wherein the power transmission for rotating the rotary cage is effected by a magnet coupling.

11. The apparatus as claimed in claim 9, wherein the heating device consists of a heating lamp.

12. The apparatus as claimed in claim 9, wherein the heating device is constructed, in case the refrigerant comprises dry ice, so as to permit variation of the heating condition in accordance with the state of sublimation dry ice.

13. The apparatus as claimed in claim 9, wherein the evacuating unit is constructed, in case the refrigerant comprises the dry ice, so as to permit variation of the evacuation condition in accordance with the state of sublimation of dry ice.

14. A freeze-dried product produced by the process claimed in claim 1.

15. A food or a medicament comprising the freeze-dried product as claimed in claim 14.

* * * * *